US011965707B1

(12) United States Patent
Helinski

(10) Patent No.: US 11,965,707 B1
(45) Date of Patent: Apr. 23, 2024

(54) METERED VOLUME WATER GUN

(71) Applicant: Edward Helinski, Johnson City, NY (US)

(72) Inventor: Edward Helinski, Johnson City, NY (US)

( * ) Notice: Subject to any disclaimer, the term of this patent is extended or adjusted under 35 U.S.C. 154(b) by 0 days.

(21) Appl. No.: 18/301,054

(22) Filed: Apr. 14, 2023

(51) Int. Cl.
*F41B 9/00* (2006.01)

(52) U.S. Cl.
CPC ..... *F41B 9/0071* (2013.01); *F41B 9/0015* (2013.01); *F41B 9/0065* (2013.01); *F41B 9/0075* (2013.01)

(58) Field of Classification Search
CPC .... F41B 9/0015; F41B 9/0065; F41B 9/0071; F41B 9/0075
See application file for complete search history.

(56) References Cited

U.S. PATENT DOCUMENTS 4,062,378 A * 12/1977 Bender ..... F16K 15/02 251/367
4,502,617 A * 3/1985 Stecker ..... B67D 7/0205 417/454
5,029,732 A * 7/1991 Wong ..... F41B 9/0071 222/379
5,074,437 A 12/1991 D'andrade et al.
5,184,755 A * 2/1993 Brovelli ..... F41B 9/0071 222/401
5,184,756 A * 2/1993 Amron ..... F41B 9/0018 222/401
5,303,848 A * 4/1994 D'Andrade ..... F41B 9/0018 222/401
5,366,108 A 11/1994 Darling
5,373,975 A 12/1994 Husted
5,448,984 A * 9/1995 Brovelli ..... F41B 9/0018 124/73
5,779,100 A * 7/1998 Johnson ..... F41B 9/0012 222/380
5,826,750 A * 10/1998 Johnson ..... F41B 9/0018 222/401
5,850,941 A * 12/1998 Johnson ..... F41B 9/0018 222/394
5,878,914 A * 3/1999 Johnson ..... F41B 9/0012 222/401
6,000,386 A * 12/1999 Johnson ..... F41B 11/54 124/71

(Continued)

*Primary Examiner* — Paul R Durand
*Assistant Examiner* — Randall A Gruby
(74) *Attorney, Agent, or Firm* — Brown & Michaels, PC

(57) ABSTRACT

A water gun, having a trigger control, provides repeated discharge of metered volume stream of water, uses a sealed chamber containing a refillable reservoir of water pressurized by compressed air. The pressurized water supply is connected to a tubular housing, which transports the stream of water to a second end of the tubular housing to a nozzle assembly. A trigger controlled valve which is connected to a trigger mechanism, having an operator controlled trigger, initiating the flow of the stream. The initiated stream is volumetrically metered and terminated by a shuttle valve, which terminates flow upon reaching a valve seat which decelerates the velocity of the shuttle before it contacts the valve seat, which reduces stress on the seal. A method of sequential resetting is provided to reset the trigger valve, trigger mechanism and shuttle valve, enabling a repeated metered discharge.

19 Claims, 8 Drawing Sheets

(56) References Cited

U.S. PATENT DOCUMENTS

| | | | | |
|---|---|---|---|---|
| 6,234,347 | B1 * | 5/2001 | Amron | F41B 9/0053 222/401 |
| 6,280,277 | B1 * | 8/2001 | Greenberg | F41B 9/0018 446/211 |
| 6,474,507 | B1 * | 11/2002 | Hornsby | F41B 9/0028 222/113 |
| 6,631,830 | B2 * | 10/2003 | Ma | F41B 9/0071 251/75 |
| 6,935,531 | B1 * | 8/2005 | Clayton | F41B 9/0075 222/401 |
| 7,458,485 | B2 * | 12/2008 | Amron | F41B 9/0018 239/222.11 |
| 7,798,364 | B1 * | 9/2010 | Eddins | F41B 11/62 239/419 |
| 8,316,897 | B2 * | 11/2012 | Lucas | F41B 9/0071 141/369 |
| 8,875,945 | B1 | 11/2014 | Loomis | |
| 10,520,275 | B2 * | 12/2019 | Ma | F41B 9/0071 |
| 2004/0261902 | A1 * | 12/2004 | Eddins | F41B 9/0071 222/79 |
| 2011/0186595 | A1 * | 8/2011 | Garces | F41B 9/0015 222/79 |
| 2013/0192576 | A1 * | 8/2013 | Ma | F41B 9/0071 124/73 |
| 2013/0193161 | A1 * | 8/2013 | Ma | F41B 9/0065 222/79 |
| 2022/0404118 | A1 * | 12/2022 | Paul | F41B 9/0006 |

* cited by examiner

METERED VOLUME WATER GUN

BACKGROUND

The present invention relates to toy water guns and particularly to high energy water guns which rapidly discharge a relatively high metered volume stream of water.

Water guns, water pistols, and toy squirt guns have evolved for many decades and continue to be popular for recreational use. Toy water pistols using a small diameter piston connected to a trigger, which is pumped manually by an operator's finger pull, have been used to pump water through tubing leading to a small nozzle which produces a small, metered volume, low energy, discharged stream of water over a short distance.

It is generally well known that large nozzles provide high energy, far reaching streams when using high pressures such as those used on fire hoses, however; applying these techniques to relatively small hand held water guns has been challenging for a number of reasons.

Large nozzles result in increased flow rates which require low impedance valving that does not restrict the flow or produce turbulence which reduces the reach of the stream. Large diameter, short length supply tubes reduce impedance related energy losses, minimize operating pressure and increase efficiency. These relatively high flow rates rapidly deplete the water reservoir of a hand-held water gun which are usually controlled by the trigger engagement time. For example, a 30 ounce reservoir of water can be discharged in about 2 seconds.

For this reason, controlling the trigger engagement time is impractical, however; controlling the discharged stream using volume metering, which provides a fixed and repeatable discharged volume for each trigger pull, solves this problem.

U.S. Pat. No. 5,074,437 describes a water gun having a sealed reservoir, which uses a manually operated air pump incorporated within its design to pressurize air and water contained within a sealed reservoir which discharges water through a tube leading to a trigger-controlled valve and nozzle. The discharged stream, however; is not metered and is dependent on the length of time the trigger is engaged by the operator.

U.S. Pat. No. 5,373,975 describes a toy water gun using pressurized air to propel water contained in a reservoir through a tube leading to a trigger-controlled valve leading to a nozzle where a stream of water is discharged. Air is compressed in the reservoir by using a household water supply which forces water into the reservoir through a separate inlet to compress the atmospheric air, in the reservoir, to provide both compressed air and water. The flow and the duration of the discharge stream is controlled by the length of time the trigger is engaged. The flow path through the valve is complex which introduces turbulence prior to discharge. There is no means of providing a metered discharge.

U.S. Pat. No. 5,366,108 also uses a municipal water supply to provide pressurized water by forcing water into the reservoir through a separate inlet to compress the air which was initially in the reservoir. The pressurized water passes into a pickup tube which exits the reservoir through a trigger-controlled valve leading to a nozzle, enclosed within a pistol grip housing, when the trigger is engaged. There is no means of providing a metered discharge.

U.S. Pat. No. 8,875,945 B1 describes a toy water gun having a water filled bladder pressurized within a permeable chamber cooperating with a separate sealed pressurized air chamber to supply pressurized water leading to a nozzle which is discharged by using a trigger-controlled nozzle valve and does not provide a metered volume discharge of water.

SUMMARY

According to one embodiment of the present invention, a far reaching, high energy hand-held water gun which repeatably discharges a metered volume stream of water having a relatively high water volume is disclosed which eliminates the difficulty of controlling a high energy stream of water using valving directly controlled by trigger engagement time, resulting in excessive discharges, which rapidly and inefficiently deplete the water volume of the reservoir.

Embodiments of the present invention provide a repeatable, efficient, and rapid discharge of a volume controller pulsed stream of water without the complexity and cost of pumps or manual pumping by an operator.

A repeatable metered volume stream of water is initiated with each trigger release but is not controlled by trigger engagement time. A method of producing various volumes of water to be discharged is discussed.

Although the use of this invention is primarily recreational, changes in design parameters suggest that it is adaptable to commercial use, such as, pesticide application and nonlethal deterrents for police use. Features such as quick and easy refilling using a household water supply along with technical features such as relatively low operating pressure and a low impedance path to the nozzle increases operating efficiency and performance as well as user satisfaction.

A water gun of an embodiment of the present invention uses a reservoir of water pressurized by compressed air, contained within a sealed chamber, having a trigger-controlled valve connected to a trigger. An operator initiates the discharge of a metered stream of water to atmospheric pressure using a trigger to initiate the flow. Water enters a first end of a tubular housing, which is immersed in the pressurized water, within the reservoir and is discharged through a nozzle, to atmosphere. The initiated stream is terminated by a moving shuttle valve which meters the volume of the discharged stream in proportion to the volume of water between the shuttles first position within the tubular housing and a second, engaged position at a valve seat where flow is terminated.

The operator resets the trigger-controlled valve consisting of a releasable plug which is seated and sealed in its reset position within a discharge port, which also resets the trigger mechanism and retains the releasable plug. The shuttle valve is reset, when an extended shaft, connected to the shuttle valve, is forcibly acted on by the releasable plug, during its manual resetting which urges the shuttle valve away from the valve seat allowing the shuttle valve to return to a first reset position, using a return spring, enabling a repeated, operator controlled metered discharge. The reservoir is refilled by inserting a quick fill connector into the discharge port which is attached to a hose connected to a household water spigot for supplying both compressed air and water to the reservoir. A separate mechanism of providing compressed air is also described.

DETAILED DESCRIPTION

Figure 1:
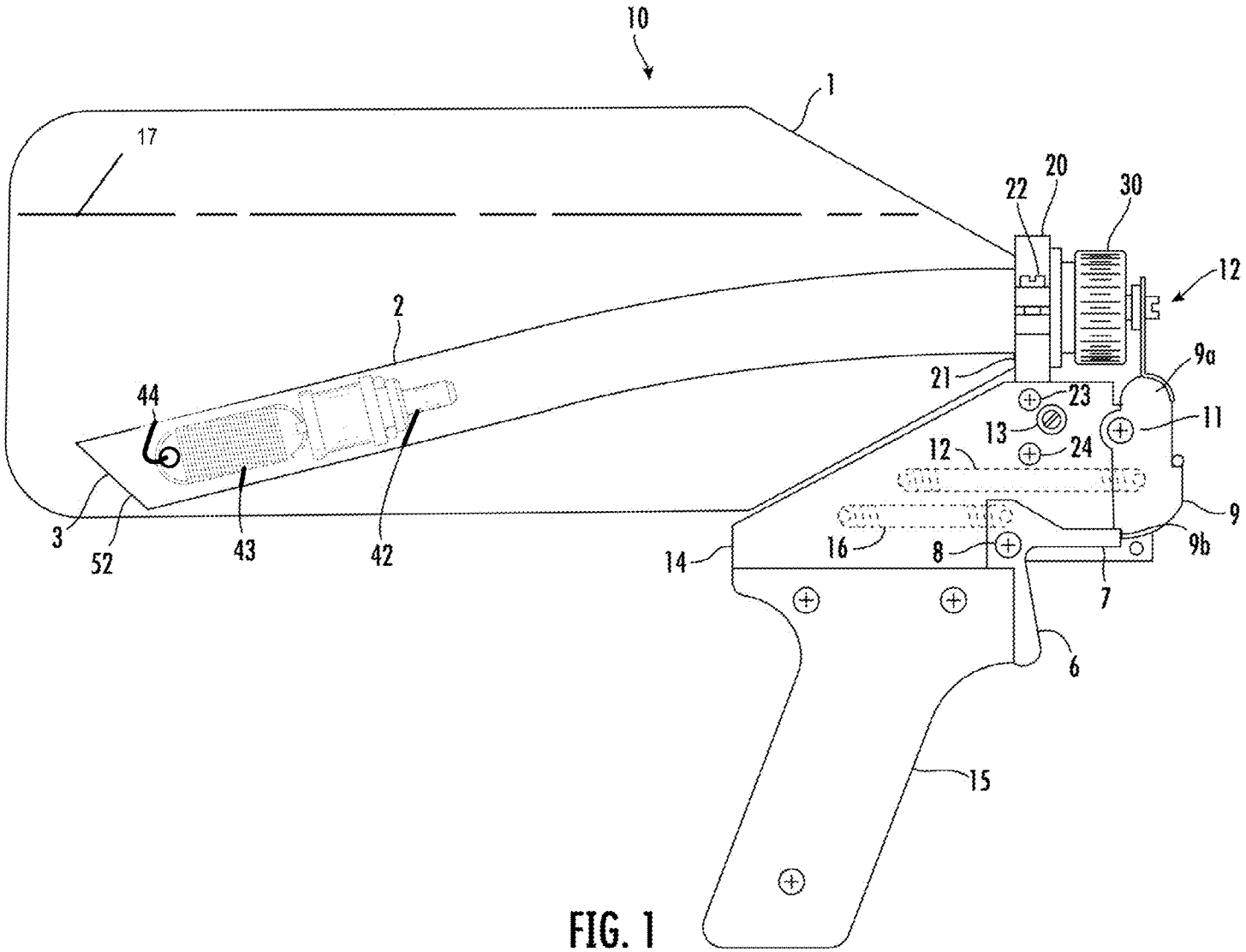
FIG. 1 shows a partially cut away side elevation view of the water gun with a tubular housing inside a sealed chamber connected to a trigger mechanism and a pistol handgrip.

A water gun (10) described in FIG. 1, utilizes a pressurized reservoir (1) of compressed air and water which is refillable providing pressurized water to produce a repeatable, trigger activated, discharged pulse of a stream of water having a metered volume. The pressurized reservoir (1) is preferably a sealed chamber. The pressurized reservoir (1) may be made using a high strength plastic such as PET polyethylene terephthalate which is used in the manufacturing of most soda bottles. The pressurized reservoir (1) is rigidly attached to a mounting plate (14) using a clamping bracket (20, 21), having an upper member (20) and a lower member (21), which clamps the neck (41) of pressurized reservoir (1) along with a tubular housing (2) shown in FIG. 2 using fastening screws (22). A flange on the pressurized reservoir (1) adjacent to the neck (41) can also be used to connect to the clamping brackets (20, 21). The lower member (21) of clamping bracket (20, 21) extends downward and is attached by flush mounted flat head countersunk machine screws (23) and (24) to mounting plate (14) which supports a trigger (6) and also provides pivotal support for pivot arm (9), using shoulder screw (11). Hand grips forming a pistol grip handle (15) are secured to a portion of the mounting plate (14) extending below the trigger (6). The pistol grip handle (15) may be made of a plastic or other suitable material in which the hand grips forming the pistol grip handle (15) can receive and be secured together by screws and threaded nuts.

The pressurized reservoir (1), as shown in FIG. 1 may be initially filled to contain about 50% water and 50% compressed air having a water line (17) with compressed air above the water line (17) and water below.

In an alternate embodiment, not shown, the pressurized reservoir is not mounted on the mounting plate (14) and is provided separately by an extended tube and compressed air, for example. In this embodiment, a tubular housing outlet (53) of the tubular housing (2) extends outside of the pressurized reservoir (1) and is connected to the mounting plate (14) using clamping brackets similar to the upper clamping bracket (20) and lower clamping bracket (21). An inlet (3) of the tubular housing (2), within the tubular housing inlet (52) is positioned and retained, immersed in water, within the pressurized reservoir (1). This allows the use of various reservoir designs which provide pressurized water using compressed air.

Figure 2:
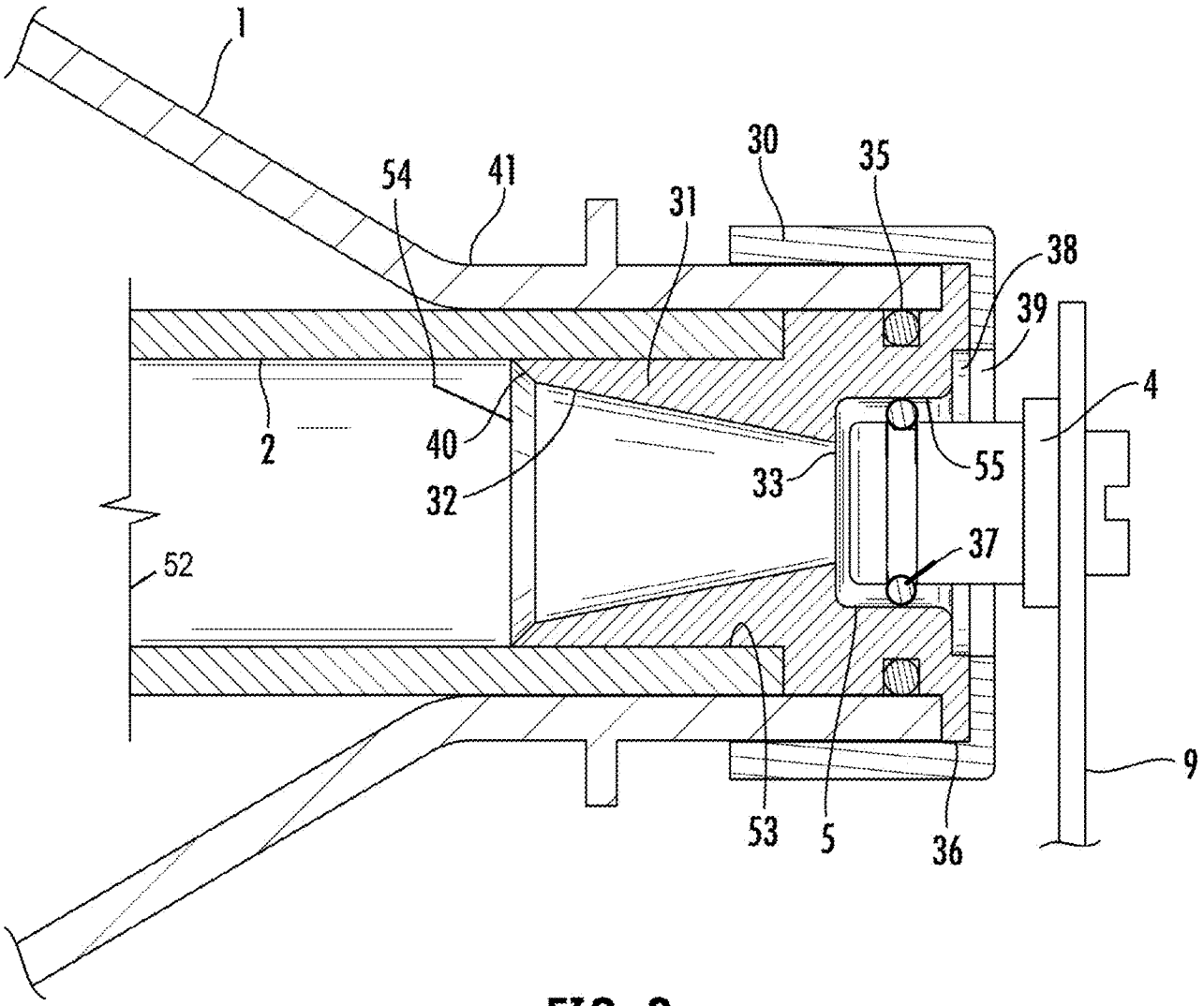
FIG. 2 shows a section view of the shuttle valve seat, nozzle, discharge port and releasable plug of the trigger-controlled valve with a partial view of the pivot arm attached.

FIG. 2 shows the tubular housing (2) containing the integral housing (31). The tubular housing (2) has a tubular housing inlet (52) at a first end which is present within the pressurized reservoir (1) and connected to a water supply pressurized by compressed air by immersion in water within the sealed chamber of the pressurized reservoir (1) and a tubular housing outlet (53) at a second end within neck (41) of the sealed chamber of the pressurized reservoir (1). The tubular housing (2) can be made of a suitable plastic. Locating the tubular housing (2) inside the sealed container (1) reduces the overall length of the design.

Within the tubular outlet (53) is an integral housing (31). The integral housing (31) has an integral housing inlet (54) at a first end and an integral housing outlet (55) at a second end. At the second end of the integral housing (31) is flanged end (36) which securely fastens to reservoir (1) using integral housing outlet (53) and a threaded end cap (30) (threads not shown). At the integral housing inlet (54) is a shuttle valve seat (40) for mating with a shuttle valve (42) described below. Between the integral housing inlet (54) and the integral housing outlet (55) is a tapered inlet (32) in fluid communication with a nozzle (33) and a discharge port (5). Nozzle (33) may have a tapered or shaped inlet leading to the point of discharge.

The integral housing (31) may be made of brass, aluminum or a suitable molded plastic and is securely sealed and fastened within tubular housing (2) by press-fitting or bonding within tubular housing (2). An O-ring seal (35) is preferably used between the integral housing (31) and the neck (41) to form an airtight and watertight seal for pressurized reservoir (1).

Figure 3:
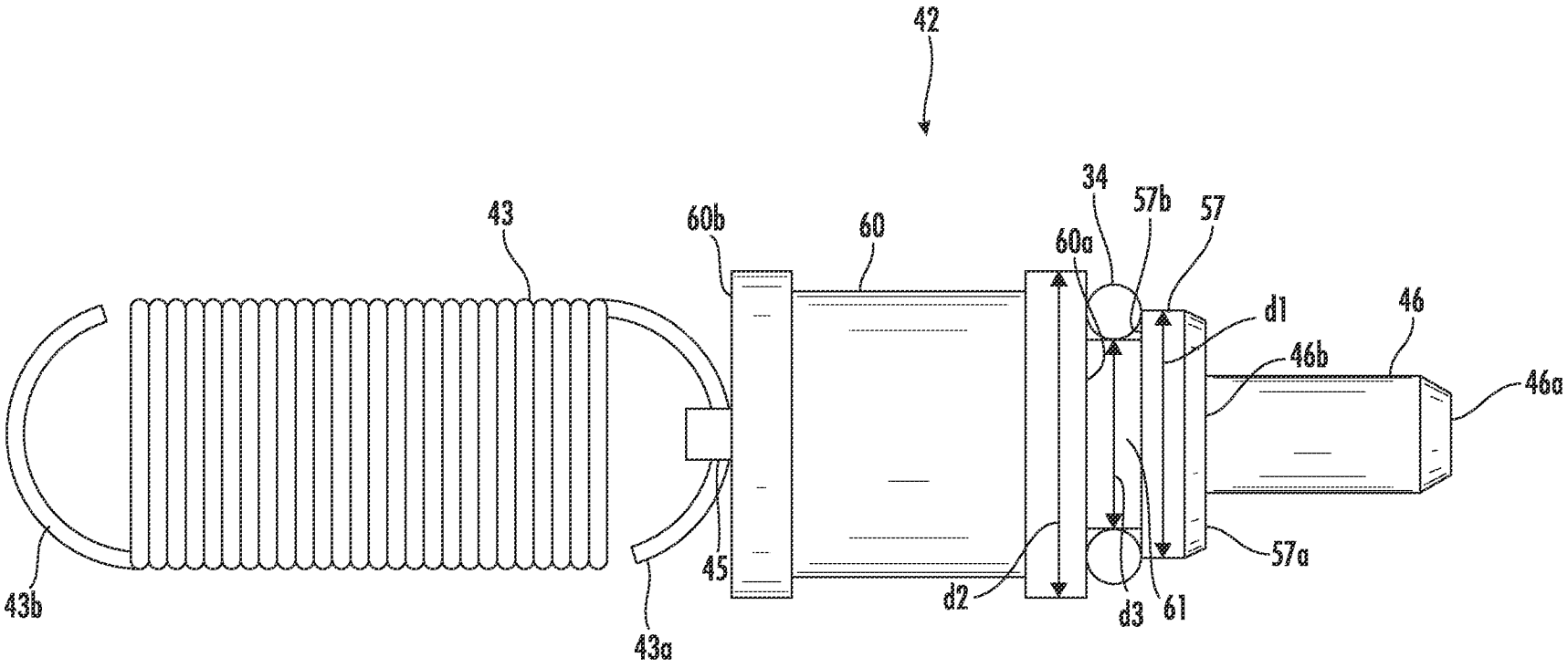
FIG. 3 shows a side elevation view, of the cylindrical shuttle for attachment to an extension spring with a pin at one end and having an extended round shaft on an opposite end.

A shuttle valve (42) described in FIG. 3 moves within the integral housing (31). The shuttle valve (42) has an extended shaft (46) with an extended shaft first end (46*a*) and an extended shaft second end (46*b*). The extended shaft second end (46*b*) is mounted to a shaft segment first end (57*a*). The shaft segment (57) has a diameter of d1. A body segment first end (60*a*) is mounted to the shaft segment second end (57*b*) through a groove (61) with a diameter of d3. The body segment (60) has a diameter of d2 at both the first body segment end and the second body segment end (60*a*, 60*b*). An elastomeric seal (34) is received on the groove (61). The elastomer seal (34) is preferably an O-ring. The diameter d3 of the groove (61) is less than the diameter d1 of the shaft segment (57) and the diameter d2 of the body segment (60). The diameter d2 of the body segment (60) is greater than the diameter d1 of the shaft segment (57). A mounting hole (45) is fixed to second body segment end (60*b*) of the shuttle valve (42).

The shuttle valve (42) is moveable between a selected unsealing, shuttle valve disengaged position in which water from the pressurized reservoir (1) flows through the nozzle (33) and out the discharge port (5) and a sealed shuttle valve engaged position in which water from the pressurized reservoir (1) is prevented from flowing through the discharge port (5) by a seal formed between the shuttle valve (42) and the integral housing (31). More specifically, the seal is formed between the O-ring (34) in the groove (61) of the shuttle valve (42) and the shuttle valve seat (40) of the integral housing.

The body segment second end (60*b*) of the shuttle valve (42) is connected to a first end (43*a*) of the extension spring (43) via mounting hole (45). A second end (43*b*) of the extension spring (43) connects shuttle valve (42) within tubular housing (2) to retaining pin (44) (shown in FIG. 1), to retain and return the shuttle valve (42) at a selected unsealing, shuttle valve disengaged position by the biasing force of extension spring (43). Extension spring (43) may be made using stainless steel spring wire.

Figure 7:
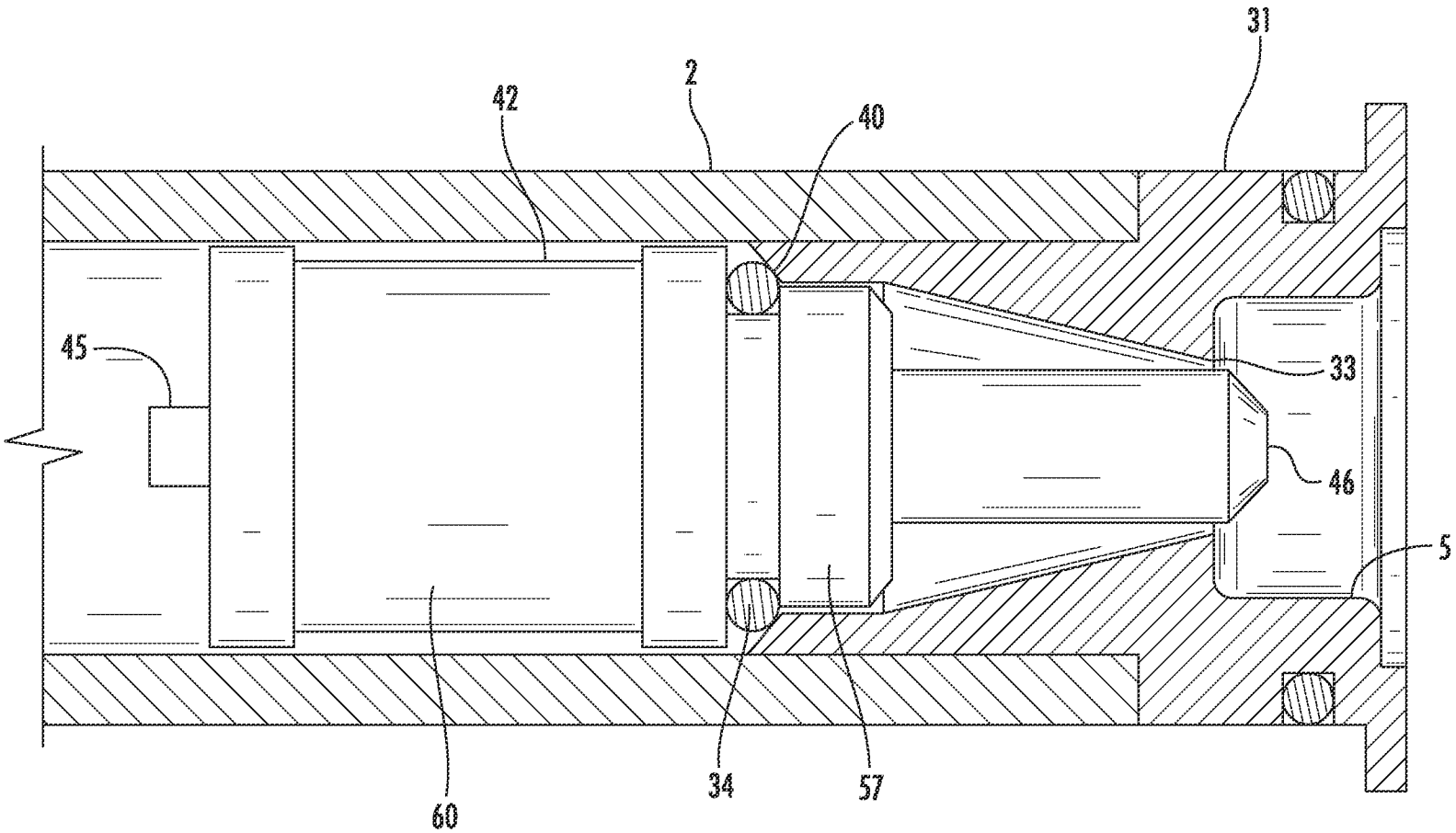
FIG. 7 shows a side cut view of a shuttle valve fully engaged with the shuttle valve seat within an integral housing.

Shuttle valve (42) is shown in FIG. 7 engaged with shuttle valve seat (40) of the integral housing (31) and comes to rest in the sealing position whereby the O-ring (34) of the shuttle valve (42) seals against shuttle valve seat (40) by water pressure from the pressurized reservoir (1), thereby terminating and metering the volume of the discharged stream of water with the extended shaft (46) of shuttle valve (42) within the nozzle (33) and protruding into discharge port (5).

Shuttle valve (42) which may be made of molded plastic, or other suitable material moves freely with the flow of water toward nozzle (33) initiated by the removal of releasable plug (4), from discharge port (5), shown in FIG. 2.

The volume of water discharged is in proportion to the volume of water between the selected unsealing, shuttle valve disengaged position and the sealed shuttle valve engaged position, plus a relativity small amount of leakage flow which passes through the clearance between the shuttle valve (42) and tubular housing (2). A splined pickup tube (not shown) can be used to increase the discharged volume of water by increasing leakage. Increasing the spring tension of the extension spring (43) also increases the discharged, metered water volume by increasing leakage around shuttle valve (42).

A releasable plug (4) is moveable between an engaged plug position in which the release plug (4) is received within the discharge port (5) and a disengaged plug position in which releasable plug (4) is not present within the discharge port (5). The position of the releasable plug (4) is determined by the position of the trigger (6) and resettable pivot arm (9). The operator can also manually replace the releasable plug (4) such that it is moved from the disengaged plug position to an engaged plug position. It is noted that other shapes of the releasable plug (4) may be used to seal the discharge port (5) and is not limited to the shape shown in the figures.

The trigger (6) is resettable between a trigger start position and a trigger actuated position. The trigger (6) is rotatably mounted to the mounting plate (14) and biased towards the trigger start position by an extension spring (16) which has a first end mounted to the trigger (6) and a second end secured to the mounting plate (14). The trigger (6) also has an axially extending retaining arm (7).

Also pivotably mounted to the mounting plate (14) via shoulder screw (11) is a resettable pivot arm (9). The first end (9*a*) of the pivot arm (9) is coupled to the releasable plug (4) via retaining screw (12) and the second end (9*b*) is engaged with and moveable by the retaining arm (7) of the trigger (6). The pivot arm (9) has a pivot arm start position and a pivot arm actuated position. In the pivot arm start position, the trigger (6) is in the trigger start position and the retaining arm (7) is engaged with the second end (9*b*) of the pivot arm (9). Extension spring (12) attached to mounting plate (14) and pivot arm (9) provides biasing force for rotation of the pivotal arm (9). The pivot arm (9) also maintains the releasable plug (4) within the discharge port (5). In the pivot arm actuated position, the trigger (6) is in the trigger actuated position and the trigger (6) is moved such that the retaining arm (7) no longer engages with the second end (9*b*) of the pivot arm (9), allowing the pivot arm (9) to rotate clockwise and remove the releasable plug (4) from the discharge port (5). Rotation continues and the second end (9*b*) of pivot arm (9) rotates clockwise and is stopped by impacting an elastomeric bumper washer (13) which is retained by a machine screw. An extension spring (12) provides biasing force assisting the release of releasable plug (4) and prevents secondary contact of the releasable plug (4) with the discharged stream of water. The pivot arm (9) may be made using formed stainless steel sheet metal.

Water enters the tubular housing (2) through the inlet (3), filling the tubular housing (2), the tapered inlet (32) and the nozzle (33). Water can flow out of through discharge port (5), adjacent the nozzle (33) when the releasable plug (4) is removed from discharge port (5). Releasable plug (4) functions as a trigger-controlled valve to initiate the release of a stream of water through nozzle (33) and out of the water gun (1).

When releasable plug (4) is removed, discharge port (5) does not increase the mechanical impedance to fluid flow because the discharged stream does not contact the bore of discharge port (5) due to its diameter being larger than the diameter of nozzle (33).

The prior art of trigger actuated water guns has described the satisfactory use of valving methods located before a discharge nozzle; however, this often results in a significant impedance and turbulence to fluid flow, when the valve is in series before the nozzle, which can reduce the reach of the discharged stream.

A metered pulse of water is discharged from the water gun (1), through the discharge port (5) by an operator actuating trigger (6), which initiates the release of a discharged stream of water. The discharge of the metered pulse of water may be repeated (after a discharge of water) by cocking pivot arm (9) to restore releasable plug (4) to its reset position within discharge port (5) which will be described in more detail below. The cocking of pivot arm (9) can be accomplished manually by an operator or by using solenoids, motors, actuators or other leveraging mechanisms. Automated cocking can be performed following a metered discharge using additional mechanisms, not shown, to act on pivot arm (9) which may result in reduced operator effort or provide other features such as semi-automatic or fully-automatic discharging.

When trigger (6) is actuated by the operator and moved to the trigger actuated position, retaining arm (7) of the trigger (6), which retains pivot arm (9) also acts as a releasable latch, which pivots about shoulder screw (8) and moves clockwise allowing pivot arm (9) to be released from retaining arm (7). Movement of the pivot arm (9) moves releasable plug (4) from the discharge port (5), initiating flow of a discharged stream of water through the nozzle (3) and out the discharge port (5).

Shuttle valve (42) engages with shuttle valve seat (40) and comes to rest in the sealing position whereby the elastomeric seal (34) of the shuttle valve (42) seals against shuttle valve seat (40) by water pressure thereby terminating and metering the volume of the discharged stream of water with the extended shaft (46) of shuttle valve (42) within nozzle (33) and protruding into discharge port (5).

A metered discharge can be repeated after resetting both the trigger (6) to the trigger start position and the shuttle valve (42) to the shuttle valve disengaged position by cocking releasable plug (4) into discharge port (5), by rotating pivot arm (9) counterclockwise where the releasable plug (4) is retained within discharge port (5) and the pivot arm (9) is captured by the retaining arm (7) of the trigger (6). More specifically, when releasable plug (4) enters into discharge port (5) during cocking, the releasable plug (4) first seals discharge port (5) and then forcibly contacts and moves the protruding end (46*a*) of extended shaft (46) sufficiently to break the seal between (34) and valve seat (40). This equalizes the pressure on both sides of the shuttle valve seat (40), after which shuttle valve (42), is no longer held in place by water pressure, allowing extension spring (43) to return and reset shuttle valve (42) to its shuttle valve disengaged position.

The clearance between tubular housing (2) and shuttle valve (42) is also sufficient to allow the return force of extension spring (43) to begin resetting shuttle valve (42) to the shuttle valve disengaged position due to leakage between the inside of tubular housing (2) around shuttle valve (42) after discharge port (5) is sealed and the pressure is equalized.

The trigger (6) is also reset to the trigger start position following the cocking of pivot arm (9) when it rotates counterclockwise and is then latched and held in a reset position by retaining arm (7). Extension spring (16) provides a counterclockwise force on retaining arm (7), enabling the latching, reset and retention of pivot arm (9).

The extended shaft (46) projecting from shuttle valve (42) as shown in FIG. 7 has a diameter only slightly smaller than the diameter of nozzle (33) and acts to decrease both the stream flow and the velocity of shuttle valve (42) before the elastomeric seal (34) contacts shuttle valve seat (40) within integral housing (31), decreasing stress on the elastomeric seal (34). Extended shaft (46) acts as a first mechanical impedance to flow when entering within tapered inlet (32) and past the opening of the nozzle (33) into discharge port (5).

Figure 6:
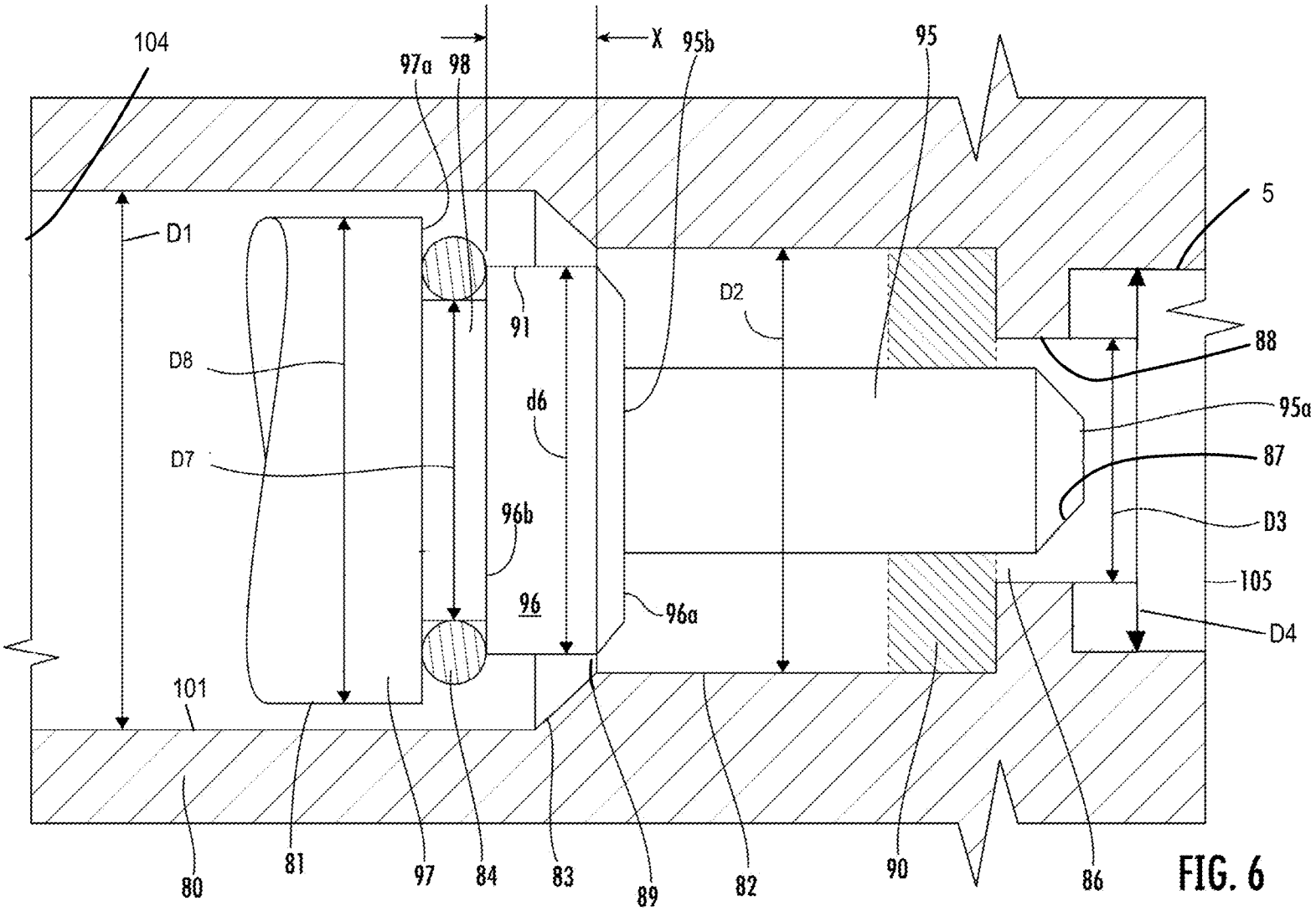
FIG. 6 shows a side cut away view of a shuttle valve not fully engaged with the shuttle valve seat within an integral housing for use with high operating pressures.

In another embodiment, a second mechanical impedance to flow is provided in combination with the first mechanical impedance resulting in the hydraulic deceleration of shuttle valve (42) and is described in greater detail using FIG. 6.

FIG. 6 shows a simplified model for the purpose of illustrating the design elements which provide hydraulic deceleration to a shuttle valve of another embodiment which reduces stress on the elastomeric seal. This is an essential feature when operating at higher operating pressure.

FIG. 6 describes a partial side sectional view of integral housing (80) with shuttle valve (81) located within the integral housing (80) which moves freely towards the nozzle orifice (88) within a pressurized stream of water flowing within integral housing (80). The shuttle valve (81) and integral housing (80) of this embodiment would replace shuttle valve (42) and integral housing (31) shown in FIGS. 3 and 7.

The shuttle valve (81) has an extended shaft (95) with an extended shaft first end (95*a*) and an extended shaft second end (95*b*). The extended shaft second end (95*b*) is mounted to a shaft segment first end (96*a*). The shaft segment (96) has a diameter of d6. A body segment first end (97*a*) is mounted to the shaft segment second end (96*b*) through a groove (98) with a diameter of d7. The body segment (97) has a diameter of d8. An elastomeric seal (84) is received on the groove (98). The elastomer seal (84) is preferably an O-ring. The diameter d7 of the groove (98) is less than the diameter d6 of the shaft segment (96) and the diameter d8 of the body segment (97). The diameter d8 of the body segment (97) is greater than the diameter d6 of the shaft segment (96). A mounting hole (not shown) is fixed to second body segment end (not shown) of the shuttle valve (81).

The integral housing (80) has an integral housing inlet (104) at a first end and an integral housing outlet (105) at a second end. While not shown, the second end of the integral housing (80) can have a flanged end similar to that shown in FIG. 2 which is securely fastened between the tubular housing outlet and a threaded end cap. The integral housing 80 has a shuttle valve seat (83) for mating with the shuttle valve (81). Between the integral housing inlet (104) and the integral housing outlet (105) is a first segment (101) with a first diameter (D1) at the integral housing inlet (104), a second segment (82) with a second diameter (D2) leading to the nozzle orifice (88), adjacent to the discharge port (5). A transition segment (83) between the first second and the second segment (101, 82) form a valve seat for the elastomeric seal (84) of the shuttle valve (81). The first diameter (D1) is greater than the second diameter (D2) and the second diameter (D2) is greater than a diameter (D3) of an orifice (88) adjacent to the discharge port (5). The discharge port (5) has a diameter (D4) which is greater than the diameter (D3) of the orifice (88).

The shuttle valve (81) is moveable between a selected unsealing, shuttle valve orifice (88) disengaged position in which water from the pressurized reservoir (1) flows through the nozzle and out the discharge port (5) and a sealed shuttle valve engaged position in which water from the pressurized reservoir (1) is prevented from flowing through the discharge port (5) by a seal formed between the shuttle valve (81) and the integral housing (80). More specifically, the seal is formed between the O-ring (84) in the groove (85) of the shuttle valve (81) and the shuttle valve seat (83) of the integral housing.

Two primary mechanical impedances to flow are present in FIG. 6 which provide a reduced clearance between the shuttle valve (81) and integral housing (80) which reduces flow and decelerates the shuttle valve (81). The first mechanical impedance (86) is formed when a portion of the extended shaft (87) of the shuttle valve (81) enters orifice (88) within integral housing (80), and a second mechanical impedance (89) is formed at the transition segment (83) between the first segment (101) with a first diameter (D1) and the second segment (82) with the second diameter (D2) and the shaft segment (96) of the shuttle valve (81). Segments of the shuttle valve (81) or corresponding integral housing (80) may be tapered to result in an increasing or decreasing impedance to outflow flow with axial motion of the shuttle valve (81) such as the increasing impedance which occurs when the end of extended shaft (95) moves within the integral housing (81).

Shuttle valve (81) is decelerated when moving within integral housing (80) over the distance (x) to displace the volume of fluid (90), represented in cross-section as the volume difference, between the two different diameters (D2, D3) of the shuttle shaft extension (95), which must be displaced by flow through the first mechanical impedance (86), or the second mechanical impedance (89), or a combination of both the impedances as long as the described combined impedance is significantly greater than the impedance of nozzle (88). An increase in the impedance will result in increased deceleration of shuttle valve (81) and reduced stress of O-ring seal (84) and increased life of the seal.

A decrease in the velocity of the shuttle valve (81) directly reduces the velocity of the column of water following the shuttle valve (81) which has a mass which increases directly with the volume of the discharged stream.

Figure 8:
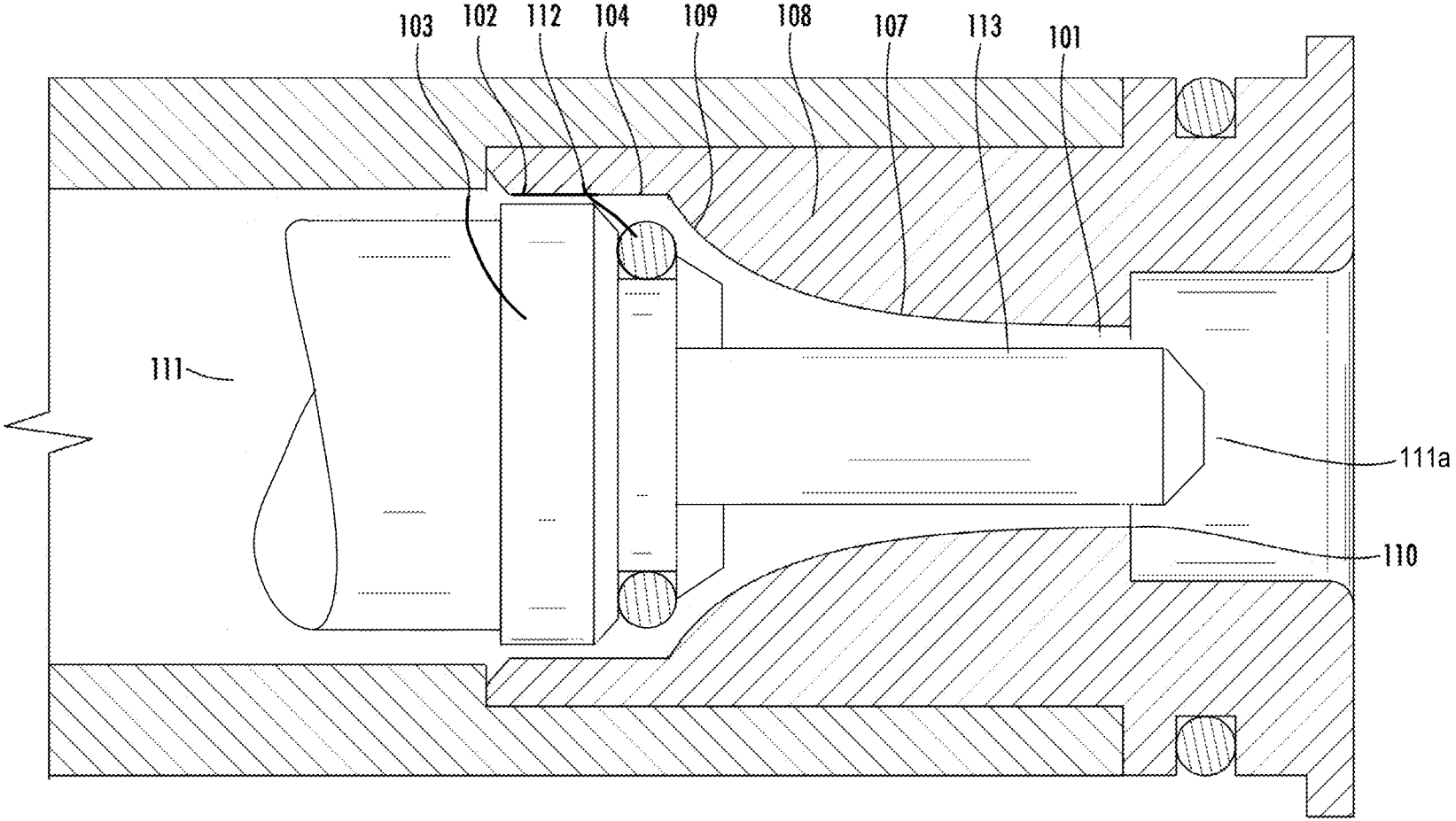
FIG. 8 shows a side cut away view of a shuttle valve not fully engaged with the shuttle valve seat having a smooth transition with the integral housing between the valve seat and the nozzle for use with high operating pressures.

FIG. 8 shows an alternative embodiment of the shuttle valve of FIG. 6. A first impedance (101) and a second impedance (102) are provided by clearance between mating segments (103, 113) of the shuttle valve (111) and the integral housing (108), which act together to provide deceleration to the shuttle valve (111) prior to the shuttle valve (111) reaching the fully engaged position. The first impedance (101) provides increasing mechanical impedance to flow during axial movement of the shuttle shaft extension (113) while the first end (111*a*) of the shuttle valve (111)

moves past the straight segment (104) and the smooth blended contour (107) of the integral housing (108) defining the valve seat (109) to the nozzle (110). The maximum impedance is obtained when a segment of the diameter near the first end (111*a*) of the shuttle shaft extension (113) of the shuttle valve (111) is aligned with a mating diameter segment of the integral housing (108) near the nozzle (110) as shown.

A second diameter segment (103) on the body of shuttle (111) provides a second impedance (102) to flow when the second diameter segment (103) enters the integral housing (108) and aligns with straight segment (104) of the integral housing (108) providing a clearance therebetween. The second diameter segment (103) has a greater diameter than the diameter of the shuttle shaft extension (103) and other parts of the shuttle valve (111).

It is noted that the described smooth blended contour (107) provides mechanical guidance to the shuttle shaft extension (113) and provides a valve seat (109) for elastomeric seal (112).

A blended contour (not shown) may also be formed on the extended shaft (113) to maximize compression and improve deceleration when compressible fluids such as air mix with water prior to fluid termination.

Figure 4:
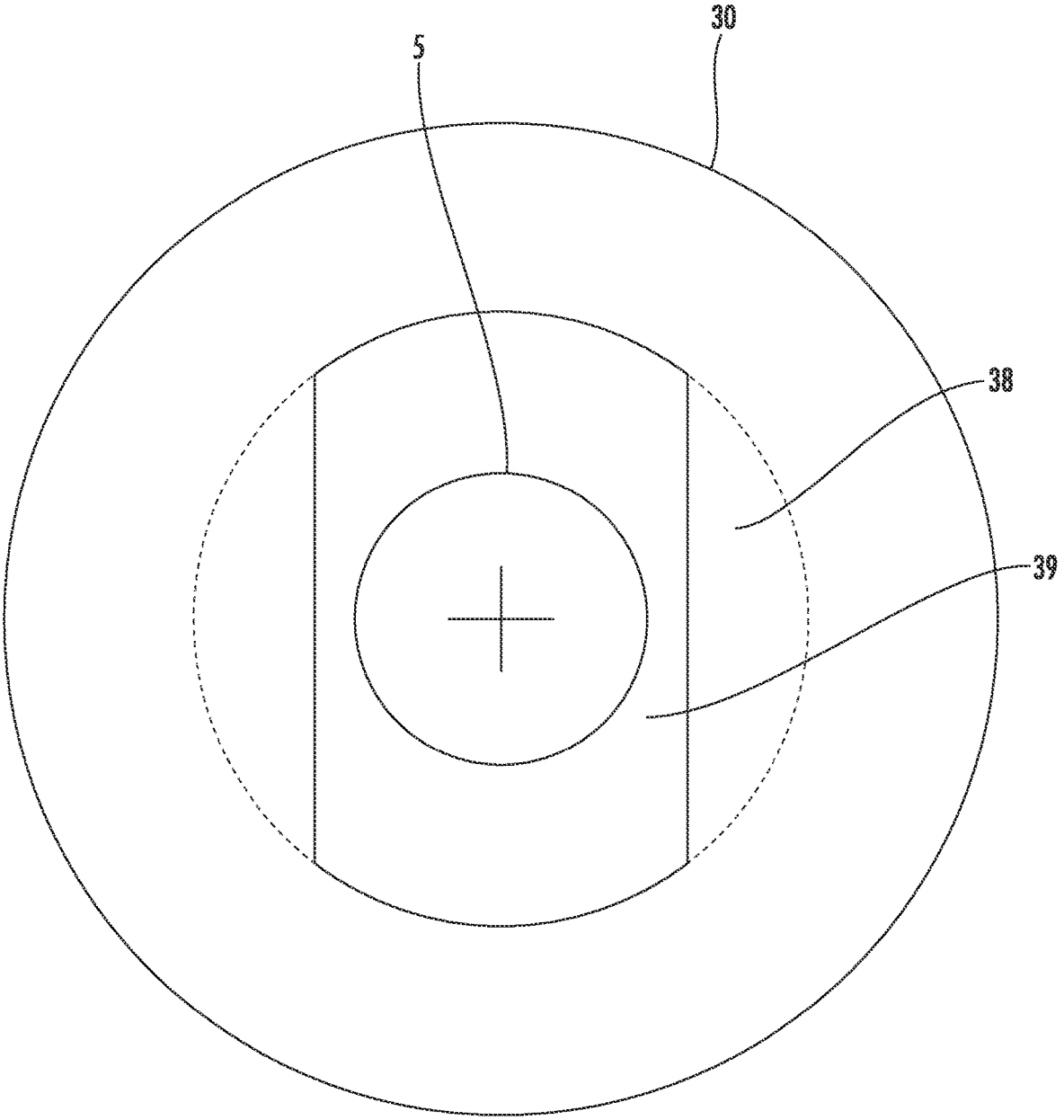
FIG. 4 shows an end view of the water gun shown in FIG. 2 without the releasable plug.

FIG. 4 describes an end view of threaded cap (30), shown in FIG. 2, which is attached to pressurized reservoir (1), without releasable plug (4) in place, showing the circular opening of the discharge port (5) which has a smooth rounded edge condition to accept releasable plug (4) shown in FIG. 2.

Integral housing (31) also provides a circular counterbored area (38) shown in FIGS. 2 and 4. Threaded cap (30) has an irregular cutout opening (39) for inserting quick twist fill plug (47) which is used to replenish the reservoir of sealed chamber (1), shown in FIGS. 5*a*-5*b*, having a flange (48) with a mating corresponding irregular shape, which passes through cutout opening (39) into counterbored area (38). Quick twist fill plug (47) has, at one end, a plug (51) having an O-ring (39) which seals discharge port (5) and locks in place when quick twist fill plug (47) is inserted and rotated one quarter turn.

A flexible hose (not shown) which surrounds and receives barbs (49) on the opposite end of quick twist fill plug (47) may be used to fill sealed chamber (1) with pressurized air and water using adapters connected to a domestic water source and spigot.

Figure 5B:
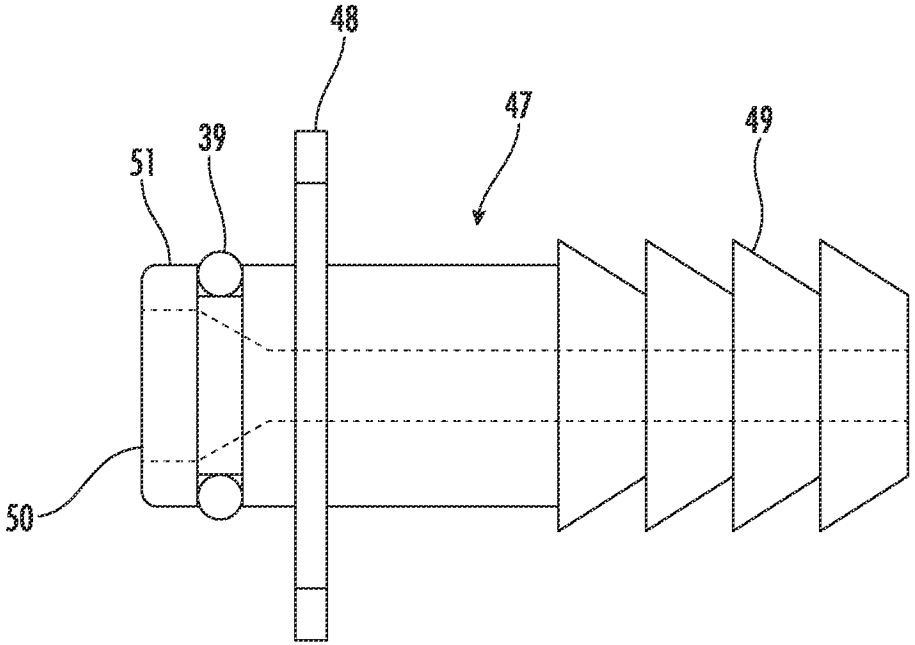
FIGS. 5*a*-5*b* shows a quick twist fill plug, with FIG. 5*b* showing a side view of a quick twist fill plug and FIG. 5*a* showing an end view of the quick twist fill plug.
Figure 5A:
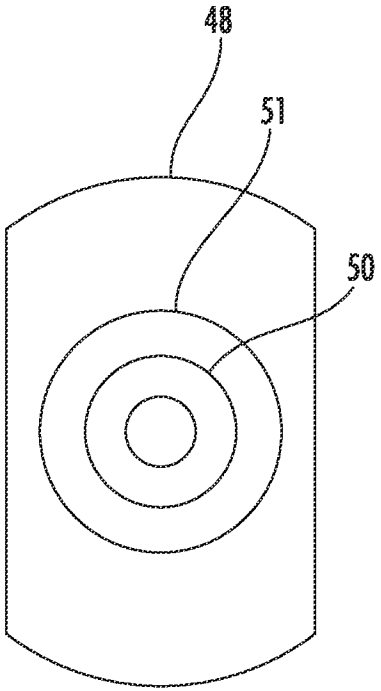

Sealed chamber (1) may be filled with air and water by inserting the plug end (51) of quick twist fill plug (47) into the discharge port (5) and applying pressurized water using a three-way valve, connected to a household water spigot, releasing shuttle valve (42) from seating within the integral housing (31) and adding water to the desired level as shown in FIGS. 5*a*-5*b*. The enlarged opening (50) in the plug end (51) prevents release of shuttle valve (42) when inserting fill plug (47). Applying water pressure releases shuttle valve (42) and initiates filling.

Switching the three-way valve stops filling and vents the discharge port (5) to atmosphere, preferably by using a separate discharge hose connected to the three-way valve. This causes the shuttle valve (42) to discharge one metered pulsed stream to atmosphere and completes the filling process and allows the removal of quick twist fill plug (47).

Increasing the volume of air within sealed chamber (1) results in improved operating performance by increasing the initial pressure in the reservoir of the sealed chamber (1) before adding water and results in an increased minimum and average operating pressure. This added air is easily supplied by using a common garden hose by leaving an increased amount of air in the hose, to supply the pressurized reservoir of the sealed chamber (1), followed by pressurized water from a household water spigot. An added pressure regulator, not shown, may be used to limit the pressure applied. A Schrader valve connected to sealed chamber (1) can be used to independently supply or adjust the desired air pressure within the sealed chamber (1).

The desired ratio of air and water in the reservoir may be obtained by changing the ratio of air and water in the hose used when filling the reservoir without using an air compressor.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A water gun providing repeated discharging of a metered volume stream of water from a pressurized water supply, the water gun comprising:

a mounting plate;

a tubular housing in fluid communication with the pressurized water supply, the tubular housing comprising a tubular housing inlet and tubular housing outlet, the tubular housing inlet being in the pressurized water supply and the tubular housing outlet comprising an integral housing having an integral housing inlet and an integral housing outlet, the integral housing defining a nozzle between the integral housing inlet and the integral housing outlet, and a discharge port at the integral housing outlet;

a releasable plug moveable between an engaged plug position in which the releasable plug is received within the discharge port and a disengaged plug position;

a shuttle valve moveable within the tubular housing between a shuttle valve engaged position in which water from the pressurized water supply is prevented from flowing through the discharge port by a seal formed between the shuttle valve and the integral housing inlet and a shuttle valve disengaged position in which the shuttle valve is disengaged from the integral housing and enabling water from the pressurized water supply to flow out the discharge port; and wherein a metered volume of the stream of water discharged through an end of the nozzle of the discharge port is in proportion to a volume of water within the tubular housing between the shuttle valve in the disengaged position and the shuttle valve in the engaged position.

2. The water gun of claim 1, further comprising a resettable trigger moveable between a trigger start position and a trigger actuated position; wherein the resettable trigger is rotatably mounted to the mounting plate having an axially extending retaining arm and coupled to a spring connected to the mounting plate.

3. The water gun of claim 2, further comprising a resettable pivot arm with a first end coupled to the releasable plug and a second end engaged with and moveable by release of the retaining arm of the resettable trigger, coupled to a pivot arm spring connected to the mounting plate, adapted to provide biasing for movement of the pivotable arm moveable between a pivot arm start position and pivot arm actuated position;

wherein when the resettable trigger is moved from the trigger start position to the trigger actuated position, the resettable trigger rotates, disengaging the retaining arm from the second end of the pivot arm, such that the pivot arm rotates, removing the releasable plug from the discharge port, initiating flow of a discharged stream of water through the nozzle and out the discharge port; and wherein when the resettable pivot arm is cocked and reset to be retained by the retaining arm of the resettable trigger, the resettable trigger is reset to the trigger start position, and the releasable plug is moved back into the discharge port such that the releasable plug biases the shuttle valve away from a valve seat enabling return of the shuttle valve to the shuttle valve disengaged position, such that discharging a metered volume of water is repeatable.

4. The water gun of claim 1, further comprising an elastomeric seal mounted on the shuttle valve to engage the valve seat within the integral housing when the shuttle valve is in the shuttle valve engaged position.

5. The water gun of claim 4, wherein the elastomeric seal is an O-ring.

6. The water gun of claim 1, further comprising a spring attached to an end of the shuttle valve biasing the shuttle valve to return to the shuttle valve disengaged position.

7. The water gun of claim 1, wherein the mounting plate further comprises a grip handle axially extending therefrom.

8. The water gun of claim 1, wherein cocking of the releasable plug attached to the pivot arm is carried out manually by an operator of the water gun.

9. The water gun of claim 1, wherein the pressurized water supply is mounted to the mounting plate.

10. The water gun of claim 1, wherein the tubular housing inlet is connected to the pressurized water supply via an extended tubular connector.

11. The water gun of claim 1, wherein the shuttle valve comprises:

an extended shaft having an extended shaft first end and an extended shaft second end;

a shaft segment having a shaft segment first end and a shaft segment second end, the shaft segment first end is mounted to the extended shaft second end; and a body segment having a body segment first end and a body segment second end, the body segment first end connected to the shaft segment through a groove formed between the body segment first end and the shaft segment second end, the groove receiving an elastomeric seal;

wherein a diameter of the shaft segment is less than a diameter of the body segment and a diameter of the extended shaft is less than the diameter of the body segment and the diameter of the shaft segment.

12. The water gun of claim 11, wherein the body segment second end further comprises an attachment point for a spring coupling the shuttle valve to the inlet of the tubular housing.

13. The water gun of claim 12, wherein when the extended shaft of the shuttle valve is received within the nozzle and the discharge port of the integral housing, such that as shuttle valve approaches the shuttle valve engaged position, a clearance between the diameter of the extended shaft and a diameter of an orifice of the nozzle in fluid communication with the discharge port provides an increased first impedance impendence to flow of water from the pressurized water supply to the discharge port, decelerating movement of the shuttle valve to the shuttle valve engaged position prior to a termination of flow of water, such that dynamic stress on the elastomeric seal is decreased.

14. The water gun of claim 11, wherein the integral housing further comprises a shuttle valve seat at the integral housing inlet, and a shaped transition extending to the nozzle.

15. The water gun of claim 11, wherein the integral housing further comprises a first segment with a first diameter at the integral housing inlet, a second segment with a second diameter forming the nozzle, adjacent to the discharge port and a transition segment between the first segment and the second segment, wherein the first diameter is greater than the second diameter and the second diameter is greater than a diameter of an orifice of the discharge port.

16. The water gun of claim 15, wherein when the extended shaft of the shuttle valve is received within the nozzle and the discharge port of the integral housing, such that as shuttle valve approaches the shuttle valve engaged position, a first clearance between the diameter of the extended shaft and a diameter of an orifice of the nozzle in fluid communication with the discharge port provides a first impendence to flow of water discharged through the nozzle, and the transition segment and a diameter of the shaft segment of the shuttle valve provides a second impendence which decelerates movement of the shuttle valve resulting from a volume of water dissipated between the first impendence and the second impedance due to a difference in diameter of the shaft segment and the extended shaft diameter during movement of the shuttle valve to the shuttle valve engaged position prior to a termination of flow of water, such that dynamic stress on the elastomeric seal is decreased.

17. The water gun of claim 1, wherein the pressurized water supply further comprises an opening to receive water and pressurized air without using a separate pressurized air supply.

18. The water gun of claim 17, wherein the opening further comprises a Schrader valve.

19. The water gun of claim 1, wherein the shuttle valve and the integral housing provide deceleration of the shuttle valve prior to the shuttle valve reaching its engaged position comprising:

at least two mechanical impedances defined between the shuttle valve and the integral housing which impede the flow, the at least two mechanical impedances comprising:

a first mechanical impedance defined within a first clearance between a first shaft segment of the shuttle valve entering the integral housing having a first diameter and a first mating segment of the integral housing for restricting flow of water; and a second mechanical impedance defined within a second clearance between a second shaft segment of the shuttle valve entering the integral housing having a second diameter, the second shaft segment being connected to the first shaft segment, and a second mating segment of the integral housing for restricting flow of water wherein the first diameter of the first shaft segment is less than the second diameter of the second shaft segment;

wherein the first mating segment and the second mating segment are axially spaced apart;

corresponding first and second mating segments of the shuttle and the integral housing are axially spaced, to act together, providing impedance to flow which decelerates the shuttle prior to the shuttle reaching its engaged position wherein a volume of water between the first mating segment and the second mating segment is displaced and the volume displaced is proportional to a difference between an area of the first diameter of the first shaft segment and the second diameter of the second shaft segment of the shuttle valve and an axial distance traveled by the shuttle valve;

wherein the first mechanical impedance and the second mechanical impedance decelerates the shuttle valve prior to the shuttle valve being in the shuttle valve engaged position, such that the deceleration is proportionate to the volume of water which was displaced though the first mechanical impedance and the second mechanical impedance and associated magnitude.

* * * * *